US008579083B2

(12) United States Patent
Astor

(10) Patent No.: US 8,579,083 B2
(45) Date of Patent: Nov. 12, 2013

(54) METHOD AND STEPLADDER WITH A TRAY

(75) Inventor: Kyle G. Astor, Meadville, PA (US)

(73) Assignee: Werner Co., Greenville, PA (US)

( * ) Notice: Subject to any disclaimer, the term of this patent is extended or adjusted under 35 U.S.C. 154(b) by 486 days.

(21) Appl. No.: 11/904,445

(22) Filed: Sep. 26, 2007

(65) Prior Publication Data

US 2009/0078504 A1 Mar. 26, 2009

(51) Int. Cl.
*E06C 7/16* (2006.01)

(52) U.S. Cl.
USPC ..... 182/124; 182/115; 182/116; 182/129; 182/152; 182/156; 182/160; 182/165; 182/173

(58) Field of Classification Search
USPC ..... 182/129, 152, 156, 160, 165, 173, 115, 182/116, 124
See application file for complete search history.

(56) References Cited

U.S. PATENT DOCUMENTS

| | | | | | |
|---|---|---|---|---|---|
| 749,670 | A * | 1/1904 | Gardner | 248/242 |
| 2,109,886 | A * | 3/1938 | Lewis | 182/124 |
| 3,387,882 | A * | 6/1968 | Mycue | 297/163 |
| 3,672,312 | A * | 6/1972 | Pettit et al. | 108/69 |
| 5,419,409 | A * | 5/1995 | Corulla | 182/129 |
| 5,722,507 | A * | 3/1998 | Kain | 182/129 |
| 6,039,149 | A * | 3/2000 | Bedja et al. | 182/20 |
| 6,390,238 | B1 * | 5/2002 | Gibson et al. | 182/161 |
| 6,550,579 | B2 * | 4/2003 | Gibson et al. | 182/161 |
| 6,880,835 | B2 * | 4/2005 | Tornabene et al. | 280/30 |
| 7,104,362 | B2 * | 9/2006 | Meeker | 182/165 |
| 7,128,187 | B2 * | 10/2006 | Simpson | 182/129 |
| 7,188,706 | B2 * | 3/2007 | Simpson | 182/129 |
| 7,370,727 | B2 * | 5/2008 | Meeker | 182/165 |
| 7,648,108 | B2 * | 1/2010 | Peterson | 248/166 |
| 2002/0017430 | A1 * | 2/2002 | Rosko | 182/129 |
| 2004/0007424 | A1 * | 1/2004 | Simpson | 182/129 |
| 2004/0231920 | A1 * | 11/2004 | Meeker | 182/165 |
| 2005/0045423 | A1 * | 3/2005 | Meeker | 182/165 |
| 2009/0032334 | A1 * | 2/2009 | Moldthan et al. | 182/118 |
| 2009/0229918 | A1 * | 9/2009 | Moss et al. | 182/129 |

* cited by examiner

*Primary Examiner* — Katherine Mitchell
*Assistant Examiner* — Colleen M Chavchavadze
(74) *Attorney, Agent, or Firm* — Ansel M. Schwartz

(57) ABSTRACT

A stepladder includes a front section having a right front rail and a left front rail in parallel and spaced relation with the right front rail, and front steps attached to the right and left front rails. The ladder includes a rear section having a right rear rail and a left rear rail in parallel and spaced relation with the right rear rail, and a rear horizontal attached to the right rear rail and the left rear rail. The ladder includes a top to which the front and rear sections are connected. The ladder includes a tray pivotally attached to the right and left rear rails having a closed position essentially in parallel with the right and left rear rails and an opened position essentially in parallel with ground, the tray pivoting up from the closed position to the open position. A method for using a stepladder. The method includes the steps of positioning a front section and a rear section of the stepladder attached to a top of the stepladder. There is the step of pivoting up a tray pivotally attached to a right rear rail and a left rear rail of a rear section of the stepladder from a closed position essentially in parallel with the right and left rear rails to an opened position essentially in parallel with ground.

5 Claims, 3 Drawing Sheets

METHOD AND STEPLADDER WITH A TRAY

FIELD OF THE INVENTION

The present invention is related to a stepladder having a tray pivotally attached to the right and left rear rails having a closed position essentially in parallel with the right and left rear rails and an opened position essentially in parallel with ground. More specifically, the present invention is related to a stepladder having a tray pivotally attached to the right and left rear rails having a closed position essentially in parallel with the right and left rear rails and an opened position essentially in parallel with ground where the tray pivots up from the closed position to the open position and can be locked in either the closed position or the open position.

BACKGROUND OF THE INVENTION

There are several different kinds of trays or shelves that are designed to work on stepladders. These trays rest below the top on the rear horizontal of the stepladder and rotate down and away from the user. The tray of the present invention is fastened to the rear side rails of the ladder and is pivoted up towards the user. The tray is now closer in line with the top of the ladder giving the user easier access to implements stored on the tray.

Most trays are situated on the rear horizontal and rotate down away from the user. There are auto closing and manual closing designs.

U.S. Pat. Nos. 7,188,706 and 7,128,187 are directed towards pivoting step stool trays. The step stools must have a pivoting step with respect to the rear or front side rails of the stool.

BRIEF SUMMARY OF THE INVENTION

The present invention pertains to a stepladder. The ladder comprises a front section having a right front rail and a left front rail in parallel and spaced relation with the right front rail, and front steps attached to the right and left front rails. The ladder comprises a rear section having a right rear rail and a left rear rail in parallel and spaced relation with the right rear rail, and a rear horizontal attached to the right rear rail and the left rear rail. The ladder comprises a top to which the front and rear sections are connected. The ladder comprises a tray pivotally attached to the right and left rear rails having a closed position essentially in parallel with the right and left rear rails and an opened position essentially in parallel with ground, the tray pivoting up from the closed position to the open position.

The present invention pertains to a method for using a stepladder. The method comprises the steps of positioning a front section and a rear section of the stepladder attached to a top of the stepladder. There is the step of pivoting up a tray pivotally attached to a right rear rail and a left rear rail of a rear section of the stepladder from a closed position essentially in parallel with the right and left rear rails to an opened position essentially in parallel with ground.

BRIEF DESCRIPTION OF THE SEVERAL VIEWS OF THE DRAWING

In the accompanying drawings, the preferred embodiment of the invention and preferred methods of practicing the invention are illustrated in which.

DETAILED DESCRIPTION OF THE INVENTION

Figure 1:
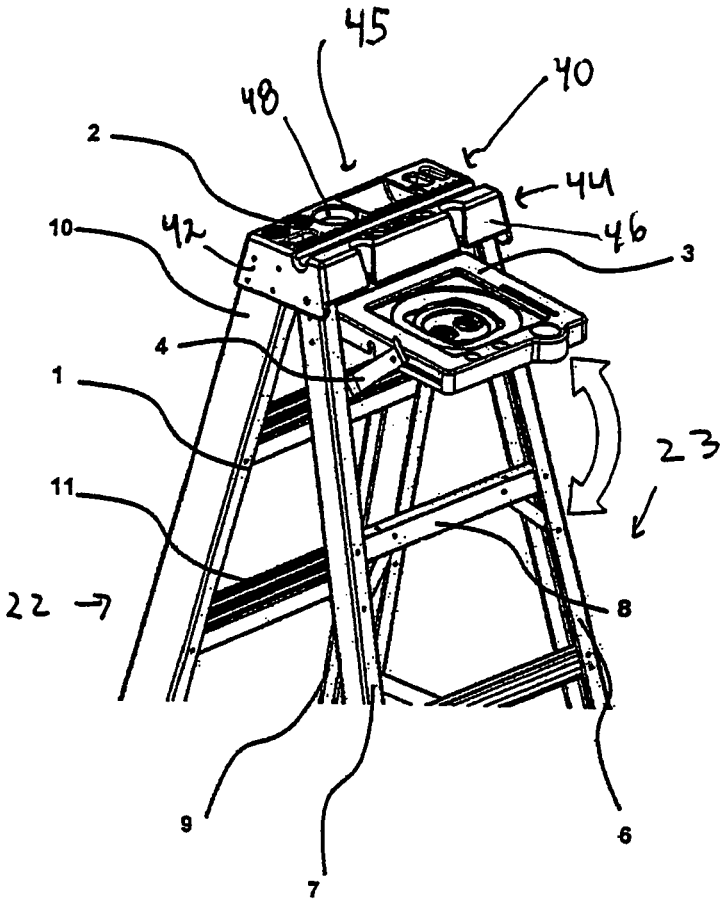
FIG. 1 is an overhead perspective view of the stepladder of the present invention with the tray in the opened position.
Figure 2:
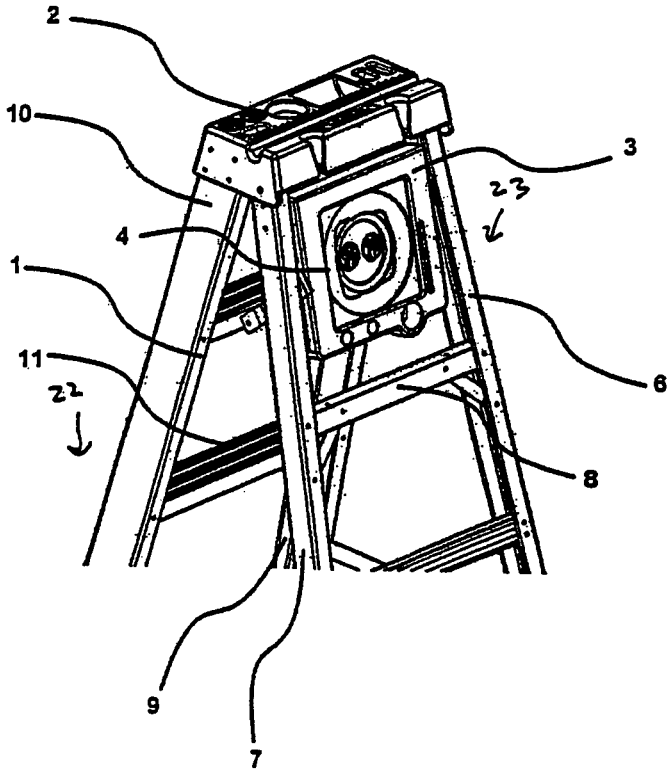
FIG. 2 is an overhead perspective view of the stepladder of the present invention with the tray in the closed position.

Referring now to the drawings wherein like reference numerals refer to similar or identical parts throughout the several views, and more specifically to FIGS. 1 and 2 thereof, there is shown a stepladder 1. The ladder 1 comprises a front section 22 having a right front rail 10 and a left front rail 9 in parallel and spaced relation with the right front rail 10, and front steps 11 attached to the right and left front rails 10, 9. The ladder 1 comprises a rear section 23 having a right rear rail 7 and a left rear rail 6 in parallel and spaced relation with the right rear rail 7, and a rear horizontal 8 attached to the right rear rail 7 and the left rear rail 6. The ladder 1 comprises a top 2 to which the front and rear sections 22, 23 are connected. The ladder 1 comprises a tray 3 pivotally attached to the right and left rear rails 7, 6 having a closed position essentially in parallel with the right and left rear rails 7, 6 and an opened position essentially in parallel with ground, the tray 3 pivoting up from the closed position to the open position.

Figure 3:
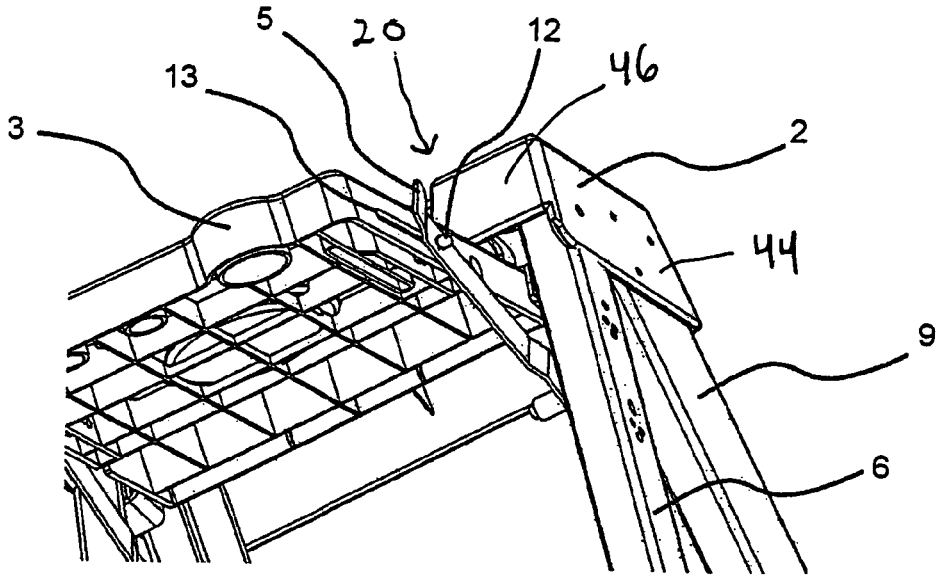
FIG. 3 is an underside perspective view of the first locking assembly of the stepladder of the present invention with the tray in the opened position.
Figure 4:
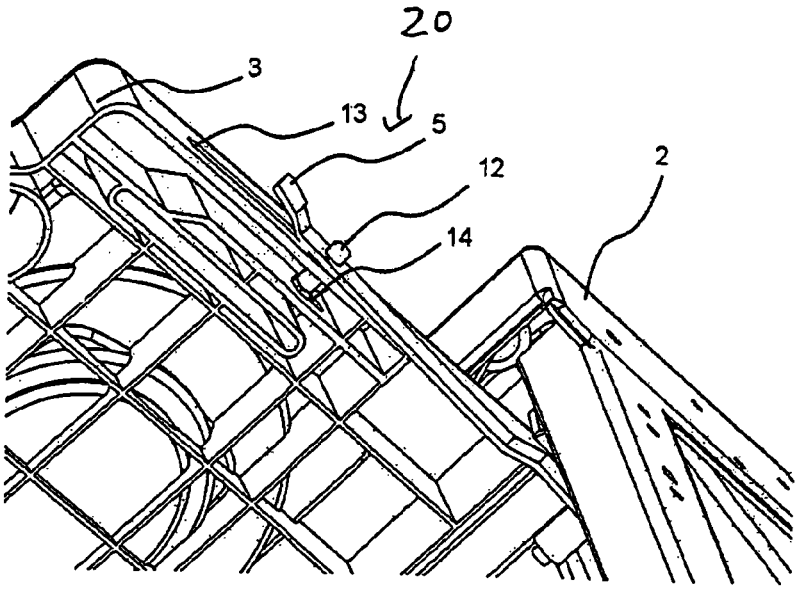
FIG. 4 is an underside perspective view of the first locking assembly of the stepladder of the present invention with the tray in the opened position.
Figure 5:
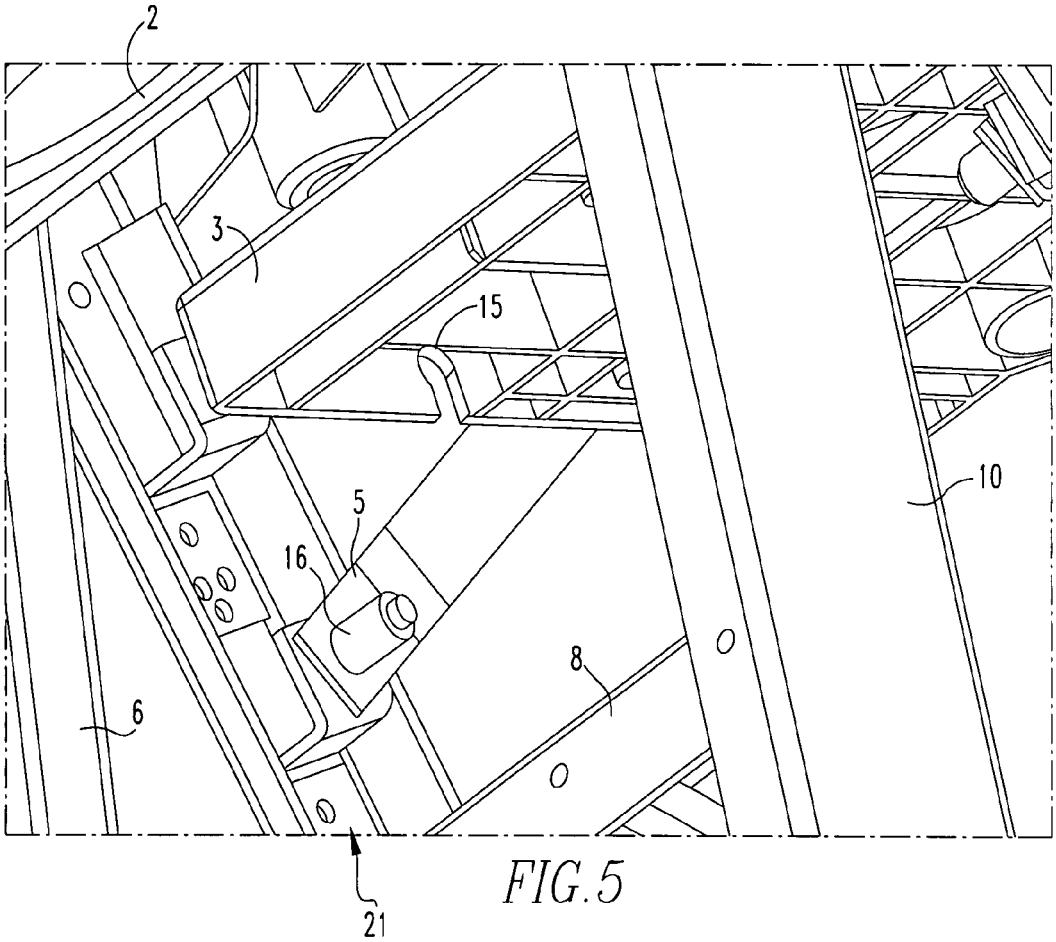
FIG. 5 is an underside perspective view of the second locking assembly of the stepladder of the present invention with the tray in the opened position.

Preferably, the stepladder 1 includes a right tray link 4 and a left tray link 5 attached to the right rear rail 7 and the left rear rail 6, respectively, and engaged with the tray 3. The stepladder 1 preferably includes a first locking assembly 20 engaged with the tray 3 and the left tray link 5 to lock the tray 3 in the opened position, as shown in FIGS. 3 and 4. Preferably, the stepladder 1 includes a second locking assembly 21 engaged with the tray 3 and the left tray link 5 to lock the tray 3 in the closed position, as shown in FIG. 5.

The tray 3 preferably includes a slot 13 and a locking hole 14, and the first locking assembly 20 includes a locking pin 12 extending into the slot 13 and attached to the left tray link 5 which moves along the slot 13 as the tray 3 goes from the closed position to the opened position and fits into the locking hole 14 when the tray 3 is in the opened position to lock the tray 3 in the opened position. Preferably, the tray 3 includes an opening 15, and the second locking assembly 21 includes a closing stud 16 attached to the left tray link 5 which snaps into the opening 15 when the tray 3 is moved into the closed position to lock the tray 3 in the closed position.

The present invention pertains to a method for using a stepladder 1. The method comprises the steps of positioning a front section 22 and a rear section 23 of the stepladder 1 attached to a top 2 of the stepladder 1. There is the step of pivoting up a tray 3 pivotally attached to a right rear rail 7 and a left rear rail 6 of a rear section 23 of the stepladder 1 from a closed position essentially in parallel with the right and left rear rails 7, 6 to an opened position essentially in parallel with ground.

Preferably, there is the step of locking the tray 3 in the opened position with a first locking assembly 20 engaged with the tray 3 and a left tray link 5 to lock the tray 3 in the opened position. There are preferably the steps of moving the tray 3 from the opened position to the closed position and locking the tray 3 in the closed position with a second locking assembly 21. Preferably, the locking the tray 3 in the opened position includes the step of moving a locking pin 12 of the first locking assembly 20 extending into a slot 13 of the tray 3 and attached to the left tray link 5 into a locking hole 14 of the tray 3 to lock the tray 3 in the opened position. The moving the tray 3 from the opened position to the closed position includes the step of snapping a closing stud 16 of the second locking assembly 21 attached to the left tray link 5 into an opening 15 of the tray 3 to lock the tray 3 in the closed position.

FIG. 1 shows the stepladder 1 with attached paint tray 3. The ladder 1 has a left front rail 9, right front rail 10, left rear rail 6 and a right rear rail 7. The front rails 9, 10 are connected with a plurality of front steps 11. The rear side rails 6, 7 are connected with a plurality of rear horizontal 8 or steps 8. The ladder top 2 connects the front and rear sections 22, 23.

The tray 3 is in the open position in FIG. 1. The right and left tray links 4 and 5 are pulled out and the tray 3 can be rotated to the closed position FIG. 2. The tray 3 when in the closed position is parallel to the rear rails 6 and 7.

FIGS. 3 and 4 are close up underside views of the assembly. The left tray link 5 is connected to the locking pin 12 which is inserted through the slot 13 in the tray 3. The top 2 has a surface 40 and has a right side 42 and left side 44 in spaced relation with the right side 42, a front side 45 and a rear side 46 in spaced relation with the front side 45. The right, left, front and rear sides extend down from the surface 40. The right and left sides connected to the front and back sides. The surface 40 having a recess 48, a right rear rail 7 of the rear section 23 attached to the right side 42 and a left rear rail 6 of the rear section 23 attached to the left side 44.

To open the tray 3, the user pulls the tray 3 from the at rest position FIG. 2 towards the top 2 of the ladder 1 until the left and right tray links 4, 5 snap into place. When the tray 3 is in the opened position, the left tray link 5 pushes the locking pin 12 into the locking hole 14 securing the tray 3, preferable parallel to the ground.

To close the tray 3, the user pulls the right and left tray links 4, 5 out. As the tray 3 is being pushed down to the closed position, the locking pin 12 slides down the slot 13 in the side of the tray 3. The opening 15 on the tray 3 snap onto the closing stud 16 which is connected to the left and right tray links 4, 5 to keep the tray closed and secure for transportation.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

The invention claimed is:

1. A method for using a stepladder comprising the steps of:

positioning a front section and a rear section of the stepladder attached to a top of the stepladder, the top has a surface and has a right side and left side in spaced relation with the right side, a front side and a rear side in spaced relation with the front side, the right, left, front and rear sides extending down from the surface, the right and left sides connected to the front and back sides, the surface having a recess, a right rear rail of the rear section attached to the right side and a left rear rail of the rear section attached to the left side, a right front rail of the front section attached to the right side and a left front rail of the front section attached to the left side;

pivoting up a tray pivotally attached to the right rear rail and the left rear rail of the rear section of the stepladder and below the top with the top extending over the tray from a closed position essentially in parallel with the right and left rear rails to an opened position essentially in parallel with and below the top surface and which causes right and left tray links to push locking pins to which each tray link is attached into a locking hole of a slot in each side of the tray, securing the tray in the opened position; and closing the tray to the closed position by pulling the left and right tray links laterally outward with respect to the tray which causes the locking pin attached to each of the right and left tray links to be moved out of the locking hole in the slot in each side of the tray and pushing down on the tray so the locking pin slides down the slot in the side of the tray.

2. A method as described in claim 1 wherein the locking pins that secure the tray in the opened position are part of a first locking assembly engaged with the tray and the left tray link to lock the tray in the opened position.

3. A method as described in claim 2 including the steps of moving the tray from the opened position to the closed position and locking the tray in the closed position with a second locking assembly.

4. A method as described in claim 3 wherein the locking the tray in the opened position includes the step of moving the locking pin of the first locking assembly extending into the slot of the tray and attached to the left tray link into the locking hole of the tray to lock the tray in the opened position.

5. A method as described in claim 4 wherein the moving the tray from the opened position to the closed position includes the step of snapping a closing stud of the second locking assembly attached to the left tray link into an opening of the tray to lock the tray in the closed position.

* * * * *